United States Patent [19]

Best

[11] Patent Number: 4,881,504

[45] Date of Patent: Nov. 21, 1989

[54] FUEL INJECTION PUMP

[75] Inventor: Christopher H. Best, Maidstone, England

[73] Assignee: Lucas Industries Public Limited Company, Birmington, England

[21] Appl. No.: 150,893

[22] Filed: Feb. 1, 1988

[30] Foreign Application Priority Data

Feb. 13, 1987 [GB] United Kingdom ..... 8703419

[51] Int. Cl.[4] ..... F02M 39/00

[52] U.S. Cl. ..... 123/447; 123/506; 123/496

[58] Field of Search ..... 123/506, 501, 447, 467, 123/496, 500; 417/462, 540, 541

[56] References Cited

U.S. PATENT DOCUMENTS

| | | | |
|---|---|---|---|
| 3,779,225 | 12/1973 | Watson | 123/506 |
| 4,029,071 | 6/1977 | Saito | 123/447 |
| 4,572,136 | 2/1986 | Takeuchi | 123/447 |
| 4,590,910 | 5/1986 | Linott | 123/506 |
| 4,592,568 | 7/1971 | Fenne | 123/447 |
| 4,601,274 | 7/1986 | Seilly | 123/447 |
| 4,612,893 | 9/1986 | Ibibashi | 123/506 |
| 4,665,875 | 5/1987 | Lakin | 123/506 |

FOREIGN PATENT DOCUMENTS

| | | | |
|---|---|---|---|
| 0114375 | 2/1986 | European Pat. Off. | 123/506 |
| 1940231 | 2/1970 | Fed. Rep. of Germany | 123/506 |
| 2023733 | 1/1971 | Fed. Rep. of Germany | 123/506 |
| 3151065 | 7/1986 | Fed. Rep. of Germany | 123/506 |
| 2107690 | 5/1972 | France | 123/506 |
| 2449795 | 9/1980 | France | 123/506 |
| 1364561 | 8/1974 | United Kingdom | 123/506 |

*Primary Examiner*—Carl Stuart Miller

*Attorney, Agent, or Firm*—Balogh, Osann, Kramer, Dvorak, Genova & Traub

[57] ABSTRACT

A fuel injection pump includes a plunger reciprocable by an engine driven cam in a bore from which extends an outlet connected in use to a fuel injection nozzle. A spill valve is utilized to control the fuel flow to the nozzle by diverting fuel from the outlet to a low pressure source. In order to prolong the valve closure period a cylinder is provided in which is located a spring loaded piston. When the valve is closed a predetermined volume of fuel is passed to the cylinder to achieve displacement of the piston after which delivery of fuel takes place through the nozzle. The period of closure of the valve in order to achieve delivery of a specific volume of fuel through the nozzle is therefore extended.

1 Claim, 1 Drawing Sheet

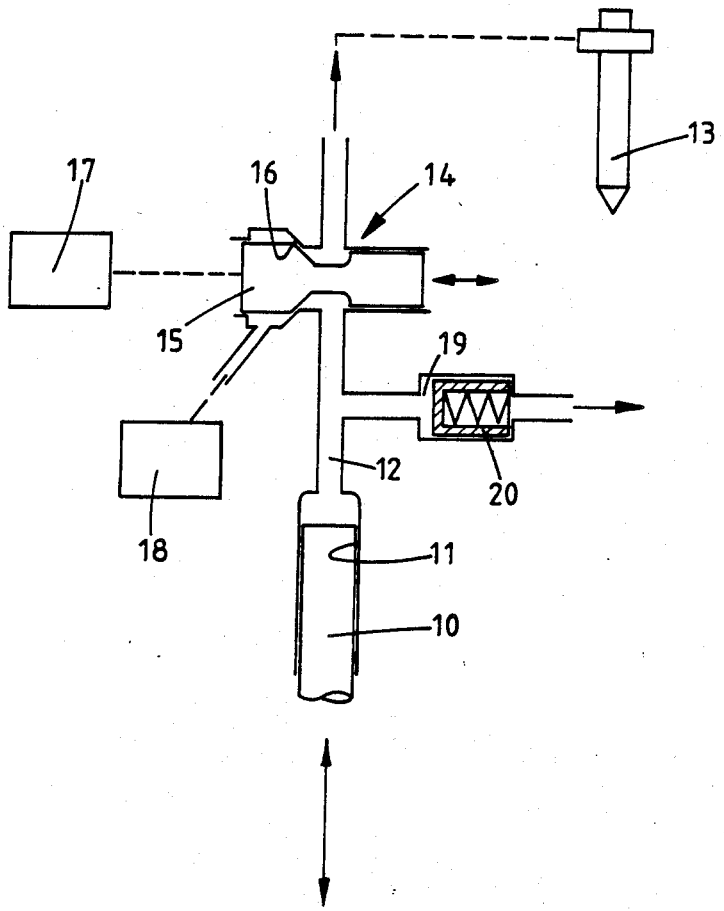
13
17
16
14
15
19
12
20
18
11
10

FUEL INJECTION PUMP

This invention relates to a fuel injection pump for supplying fuel to an internal combustion engine and of the kind comprising a plunger reciprocable within a bore, the plunger being reciprocated in time relationship with the associated engine, an outlet from the bore and connected in use to an injection nozzle of an associated engine and a spill valve through which fuel displaced from the bore during a pumping stroke of the plunger can flow thereby to control the quantity of fuel supplied through the injection nozzle.

With such a pump as the speed of the associated engine increases the time period during which the valve must remain closed must be decreased if the same quantity of fuel is to be delivered through the nozzle. In terms of degrees of rotation of the crankshaft of the engine the period remains constant. Moreover, as the quantity of fuel which it is required to supply to the engine decreases, the period of closure becomes shorter.

The spill valve, particularly if it is operated by an electromagnetic means, will require a first predetermined time to close following the application of a control signal to the means and also a second predetermined time to open following removal of the control signal. The actual period of closure may be very short as compared with the aforesaid times. Furthermore, it is found that delivery of fuel through the outlet can start to occur before the valve member of the valve reaches its fully closed position and also it will continue to take place after the valve member has started to move towards its fully open position. The operation of the spill valve when small quantities of fuel are required to be delivered to the engine and particularly at high engine speeds is therefore difficult to control.

A known solution to the above problem is to arrange that one or more of the engine cylinders of the engine are deprived of fuel and to further arrange that the remaining cylinders receive more fuel to maintain the engine power. An undesirable effect is that cooling of the cylinders which receive no fuel takes place leading to poor combustion of the fuel when the fuel supply is restored. This can be alleviated by arranging for cyclic interruption of the fuel to flow to the engine cylinders. This however increases the complexity of the control system.

The object of the present invention is to provide a pump of the kind specified in a simple and convenient form.

According to the invention a fuel injection pump of the kind specified comprises a resiliently loaded piston housed within a cylinder which is in communication with said bore, whereby upon closure of the spill valve during a pumping stroke of the plunger a predetermined volume of fuel will be displaced from the bore to the cylinder before fuel is supplied through the injection nozzle connected to the outlet so that the period during which the spill valve must be closed to achieve delivery of a predetermined volume of fuel through the nozzle, is extended.

An example of a fuel injection pump in accordance with the invention will now be described with reference to the accompanying diagrammatic drawing.

The pump comprises a plunger 10 housed within a bore 11. The plunger can be moved inwardly to displace fuel through an outlet 12, by means of an engine driven cam not shown and it may be moved in the opposite direction by means of a spring.

The outlet 12 is connected to a fuel injection nozzle 13 of an associated engine and for controlling the quantity of fuel supplied to the injection nozzle there is provided a spill valve generally indicated at 14.

The spill valve includes a slidable valve member 15 which can be urged into contact with a seating 16, by energisation of an electromagnetic device 17. In the open position of the valve member the outlet 12 is connected with a low pressure source of fuel 18. In operation, during inward movement of the plunger 10 by the cam, fuel is displaced through the outlet 12 and if the spill valve 14 is open, the fuel will be displaced to the source 18. However, when the spill valve is closed by energisation of the electromagnetic device 17, the fuel will flow to the injection nozzle 13 and will be delivered to a combustion space of the associated engine. The supply of fuel will cease when the spill valve 14 is opened upon de-energisation of the device 17. Fuel is supplied to the bore 11 from the source 18 during downward movement of the plunger, the spill valve 14 remaining open for filling purposes.

In order to extend the period during which the spill valve must be closed to obtain delivery of a predetermined quantity of fuel to the engine, there is provided a cylinder 19 in which is located a resiliently loaded piston 20. The end of the cylinder towards which the piston is moved by the spring, is connected to the outlet 12. The force exerted by the spring on the piston is such that after closure of the spill valve the piston will move through a predetermined distance before the pressure of fuel is sufficient to open the spring loaded valve member of the nozzle 13. At the same time however the strength of the spring is such that when the spill valve is opened following delivery of fuel, the piston will return under the action of its spring to its initial position.

In use when the spill valve is closed during inward movement of the plunger, the piston will move in its cylinder against the action of its spring, to absorb a predetermined volume of fuel displaced by the plunger 10 before the pressure of fuel rises sufficiently to open the valve in the injection nozzle. When the spill valve is opened to terminate delivery of fuel, the pressure in the outlet 12 will fall to that of the source 18 and the piston will return to its initial position. The overall effect is that the period during which the spill valve must be closed to achieve delivery of a volume of fuel is extended.

I claim:

1. A fuel injection pump for supplying fuel to an internal combustion engine comprising a plunger reciprocable within a bore, means including a cam driven by the associated engine for causing reciprocation of the plunger, an outlet from the bore, said outlet being connected to a fuel injection nozzle of said engine, a spill valve connected to said outlet, said spill valve including a spill valve member movable into contact with a seating to prevent flow through said valve, an electro-magnetic device coupled to said spill valve member, said device when energized causing movement of said valve member into contact with said seating and a resiliently loaded piston located upstream of said spill valve and housed within a cylinder, said piston and cylinder in communication with said outlet whereby upon closure of said spill valve during a pumping stroke of said plunger, fuel will be displaced from said bore to said cylinder, said piston moving in response to fuel displaced by said spill valve and said plunger so as to maintain the fuel pressure in said bore at a level below the pressure of fuel required to open a valve in said injection nozzle, until a predetermined movement of said piston has taken place.

* * * * *